United States Patent [19]

Church et al.

[11] Patent Number: 4,507,041

[45] Date of Patent: Mar. 26, 1985

[54] LOAD-TILT ATTACHMENT EMPLOYING A PINION GEAR ARRANGEMENT

[76] Inventors: William H. Church, P.O. Box 157; James E. Teichman, 4689 Tabor Rd., both of Sodus, Mich. 49126

[21] Appl. No.: 418,220

[22] Filed: Sep. 15, 1982

[51] Int. Cl.[3] ..... B66F 9/16

[52] U.S. Cl. ..... 414/641; 74/89.17

[58] Field of Search ..... 414/422, 620, 640, 641, 414/672; 74/89.17, 422

[56] References Cited

U.S. PATENT DOCUMENTS

| | | | |
|---|---|---|---|
| 177,507 | 5/1876 | Hiatt | 414/381 |
| 2,335,572 | 11/1943 | Schroeder | 414/607 |
| 2,541,268 | 2/1951 | Milz | 414/641 |
| 2,810,488 | 10/1957 | Arnot | 414/620 |
| 2,822,949 | 2/1958 | Sinclair | 414/641 |
| 2,979,217 | 4/1961 | Tomasovich | 414/641 |
| 3,066,807 | 12/1962 | Draxler | 414/641 |
| 4,095,714 | 6/1978 | Schuster | 414/607 |

FOREIGN PATENT DOCUMENTS

| | | | |
|---|---|---|---|
| 960792 | 6/1964 | United Kingdom | 414/620 |
| 727561 | 4/1980 | U.S.S.R. | 414/620 |

*Primary Examiner*—Joseph E. Valenza
*Assistant Examiner*—Stuart J. Millman
*Attorney, Agent, or Firm*—Harry G. Thibault

[57] ABSTRACT

An improved load-tilt attachment including a particular arrangement for rotating a receptacle carried on the front plate of the load-tilt attachment, the attachment being mountable on an upright for a vehicle. The improved attachment comprises a gear support means mounted in generally parallel alignment with a reciprocal moving means which is connected to a longitudinal gear section mounted on the linear gear support means for reciprocal movement.

22 Claims, 4 Drawing Figures

LOAD-TILT ATTACHMENT EMPLOYING A PINION GEAR ARRANGEMENT

FIELD OF THE INVENTION

The subject invention pertains generally to a load-tilt attachment, particularly one used on an upright of a vehicle.

DESCRIPTION OF THE PRIOR ART

Generally, the movement of material from one location to another involves loading a receptacle at a series of decentralized locations and dumping it at a central location. When the receptacle comprises a box mounted on an upright and the movement of the box is generally restricted along the vertical axis of the upright, means for mechanically dumping the contents of the box are limited.

Prior art solutions to the problem include the use of a pinion gear in combination with a rack, a second intermeshed gear section.

However, such a general arrangement does not provide an entirely satisfactory answer to the problem as evidenced by even the earliest prior art.

Consider U.S. Pat. No. 177,507—Hiatt, entitled "Dumping Box" and issued May 16, 1876 which employs rack D, guide bar D' and pinion gear or cogwheel C' and yet further requires a second guide-bar E for engaging guide-pins a for further support of dumping box A.

Another prior art arrangement can be seen in U.S. Pat. No. 2,979,217—Tomasovich, entitled "Load Rotating Device" and issued Apr. 11, 1961 in which an arcuate gear section 15 engages a pinion gear 16 for rotation of a plate rigidly secured to the pinion gear 16. The gear section 15 is connected radially to an upright hydraulic ram pinned at opposite ends to permit arcuate movement of gear section 15. However, the arrangement of Tomasovich permits the hydraulic ram to freely rotate between its pivoted ends, limiting the stability of the arrangement. Further, the use of a radial attachment for gear section 15 and the use of an arcuate gear section 15 produces a loss of efficiency in load transfer from the ram to gear section 15 in the prior art arrangement.

Other prior art arrangements which purport to solve the problem noted above can be found in U.S. Pat. Nos. 2,335,572, 3,066,807 and 4,095,714. However the disadvantages of such arrangements can be easily found when they are compared to the present invention.

SUMMARY OF THE INVENTION

The present invention discloses a particular arrangement for rotating a receptacle carried on the front plate of a load-tilt arrangement mountable on an upright for a vehicle.

Specifically, the load-tilt attachment includes a rear plate, a horizontal guide rail mounted on the rear plate and rigidly pinned at opposite ends thereof, a longitudinal gear tooth section or rack moveable along the guide rail and a hydraulic cylinder oriented generally parallel to the guide rail to reciprocally move the gear section along the guide rail. The cylinder is pinned to the plate at opposite ends with one end pinned to the outer edge of the plate and the opposite end secured to the gear section mounted on the plate.

A central post, located above the rack receives the bore of a pinion gear rigidly mounted on the rear of the front plate of the attachment. A front face of the collar on the rear plate engages the rear face of the pinion gear on the front plate to provide clearance between the front face of the rear plate and the rear face of the front plate for the hydraulic cylinder and the rack.

The respective gear sections mesh when the front face of the collar on the rear plate and the rear face of the pinion on the front plate engage. A retaining cap overlies the post and the front plate to secure the assembly together.

Obvious advantages of the present invention over the above-cited prior art include direct connection of the hydraulic ram to the rack mounted on the rigid guide rail. The hydraulic ram is protected against overtravel at opposite ends by defined stops on the guide rail. The rack directly overlies the hydraulic cylinder for efficiency of load transfer and a guard mounted on the rear plate overlies the mechanism and protects the moving parts of the assembly from obstructions encountered in the work environment.

These and further advantages can be more readily ascertained from a consideration of the detailed description of the subject invention as set forth below and an examination of the drawings which accompany the detailed description.

DETAILED DESCRIPTION OF THE PREFERRED EMBODIMENT

Figure 1:
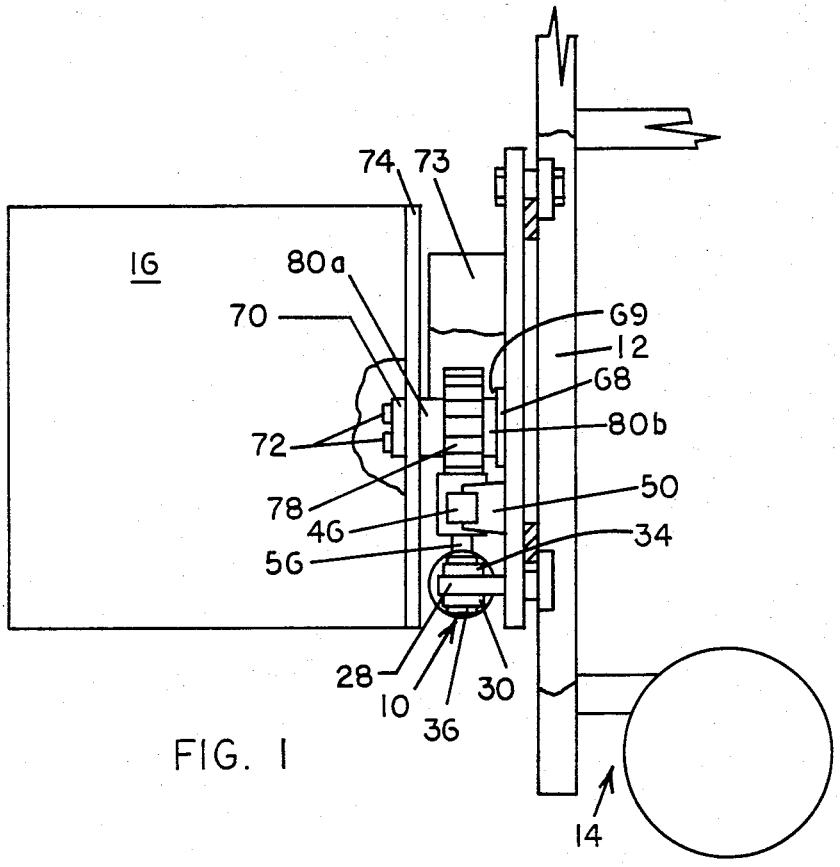
FIG. 1 is a perspective view of the attachment of the present invention as it is intended to be mounted on an upright of a vehicle, a load receptacle shown mounted on the front plate of the attachment for clarity.

The load-tilt attachment 10 of the present invention may be mounted, as shown in FIG. 1, on an upright 12 of a vehicle 14. A detailed description of the upright 12 or the vehicle 14 is not required since such elements do not represent essential features of the present invention but rather demonstrate the environment in which the attachment 10 operates. As a further demonstration of environment a receptacle 16 is shown mounted on the front of the attachment 10. Again, neither the form of the receptacle 16 nor the method of its attachment form an essential element of the present invention and, thus, neither is detailed below.

Figure 2:
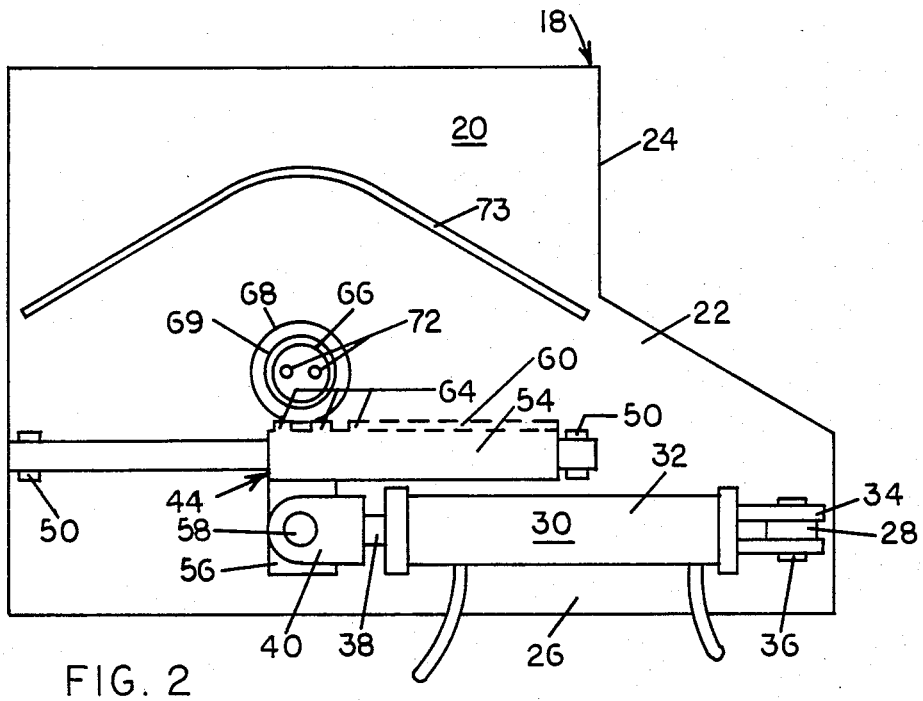
FIG. 2 is an elevational view of the front face of the rear plate of the attachment.
Figure 3:
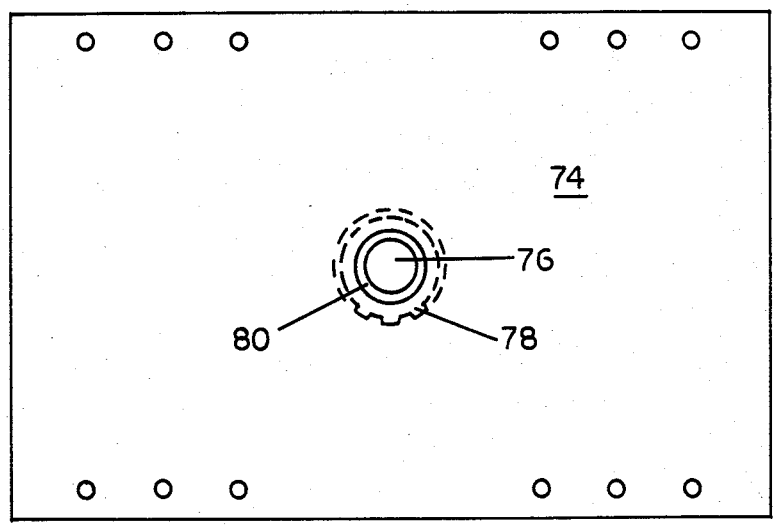
FIG. 3 is an elevational view of the rear face of the front plate of the attachment.
Figure 4:
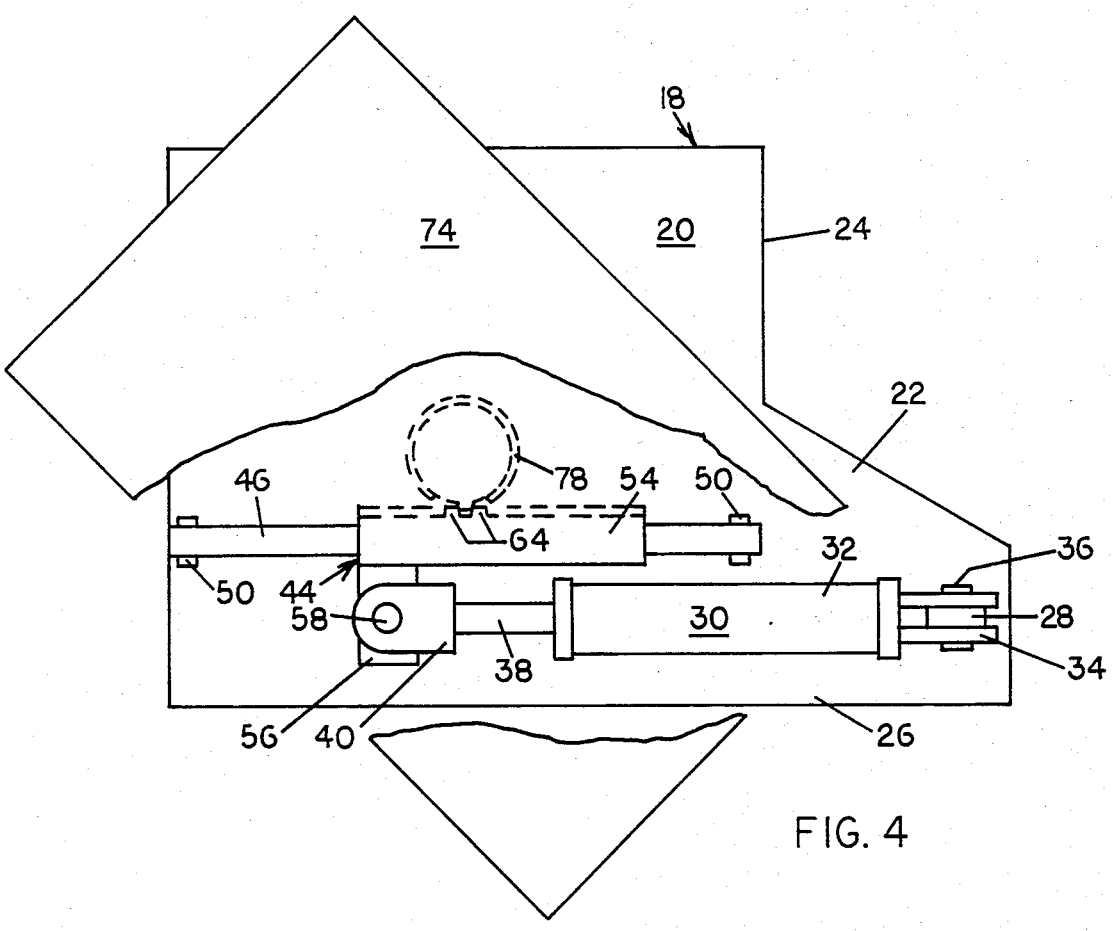
FIG. 4 is a front elevational view of the assembled attachment with portions thereof broken away for clarity.

Referring now to FIGS. 2, 3 and 4, the load-tilt attachment 10 comprises a rear plate 18 having a front face 20. The rear plate 18 is of generally rectangular configuration with a triangular extention 22 at one vertical edge 24 thereof at a lower right-hand portion 26 (as viewed in FIG. 2) to accommodate a mounting lug or ear 28 for hydraulic cylinder 30. Cylinder end 32 of cylinder 30 includes a clevis 34 overlaying the lug 28 and held in place by pin 36. Rod end 38 of cylinder 30 carries a clevis 40 which engages a longitudinal gear tooth section or rack 44 which travels reciprocally along a guide rail 46 as will be described in more detail below.

Guide rail 46 having rack 44 secured thereto is mounted horizontally on the front face 20 of rear plate 18. Triangular supports 50 are rigidly secured, as by welding, at opposite ends of the rail 46. The supports are then rigidly secured or welded in place on the rear plate 18 to orient the guide rail 46 in generally parallel alignment with the longitudinal axis of the hydraulic cylinder 30. In the preferred embodiment guide rail 46 comprises a solid bar of rectangular cross-section. However, the cross-sectional configuration of the guide rail 46 is not an essential element of the present invention and the guide rail 46 need not even be a solid bar since it is not a major load-bearing element of the subject attachment.

Rack 44 comprises a hollow rectangular tube 54 sized generally to conform to and to reciprocally move along the guide rail 46. At its lower end 52 the tube 54 carries an ear or lug 56 rigidly mounted thereon. The lug 56 receives the clevis 40 carried on cylinder end 38 of the cylinder 30 and pin 58 secures lug 56 and clevis 40 together. At its upper end 60 the tube 54 carries a longitudinal array of gear teeth 64 horizontally oriented with respect to the cylinder 30 and the rear plate 18 and rigidly mounted on the tube 54. Gear section 44 moves reciprocally along guide rail 46 in response to inputs to double-acting hydraulic cylinder 30. The end supports 50 of guide rail 46 serve as stops to limit the longitudinal travel of the rack section 44 at opposite ends of guide rail 46.

A central post 66 is rigidly mounted to rear plate 18. A collar 68 protrudes from rear plate 18 to provide a step portion 70 between the rear plate 18 and the post 66 for rigidity and support as is further explained below. A retainer cap 70 is provided at the outer end of the post 66 for a purpose to be described below. Fasteners 72 threaded into the outer end of post 66 hold the retainer cap 70 in place. A protective strip 73 extends longitudinally across the upper half of rear plate 18 in a generally triangular configuration to protect the working elements of the attachment 10 from its operative environment.

Refer now to FIG. 3, wherein is shown the rear of a front plate 74. Front plate 74 comprises a generally rectangular plate having a central opening 76 surrounded by a pinion gear 78 having front and rear step portions 80*a* and 80*b*, the gear 78 rigidly mounted at step portion 80*a* on the rear of plate 74.

Opening 76 of front plate 74 is received on the central post 66 of rear plate 18 and pinion gear 78 engages the rack 44. Collar 68 on the rear plate 18 engages the rear face of the rear step portion 80*b* of the pinion gear 78 to provide clearance between the front plate 74 and the rear plate 18 to accommodate rotation of the front plate 74 by interaction of cylinder 30 and gears 44 and 78.

Retainer cap 70 overlies opening 76 at the front of the front plate 74 and the fasteners 72 are secured in place to hold front plate 74, rear plate 18, gear elements 44 and 78 and other constituent elements of load-tilt attachment 10 in assembled relation.

The assembled load-tilt attachment operates as follows:

Hydraulic fluid input to one side of the double acting hydraulic cylinder 30 causes the longitudinal gear section 44 to travel along guide rail 46, thereby rotating pinion gear 78, front plate 74 and receptacle 16 secured to front plate 74 to dump the material contained in receptacle 16. The assembly of the front plate 74 and the receptacle 16 attached thereto is capable of 360 degree rotation from one end to the other of guide rail 46 but supports 50 for guide rail 46 serve as stops limiting the travel of cylinder 30 in opposite directions as well as limiting the degree of rotation of front plate 74. Cylinder 30 and gear section 44 are in parallel alignment to assure efficiency of load transfer therebetween.

The present invention offers an improved, more efficient method of solving the problem considered by the prior art and represents a patentable advance over such art. Having thus described a preferred embodiment of the present invention, it should be apparent to those skilled in the art that modifications may be made in the structure illustrated. That is, equivalent elements may be substituted for the structure which has been disclosed. It is therefore, intended that all such modifications and substitutions be embraced by the appended claims.

We claim:

1. An improved load-tilt attachment mountable on the upright of a vehicle, said load-tilt attachment comprising a rear plate, a linear guide rail rigidly secured to the rear plate to receive a longitudinal gear section for reciprocal movement thereon, means for reciprocally moving the longitudinal gear section along the guide rail, said means displaced from and in parallel alignment with the guide rail, plate rotary support means mounted on the rear plate, a front plate mounted on the plate rotary support means for rotary movement of the front plate with respect to the rear plate, mounting means on the front plate comprising a central opening received on the rotary support means of the rear plate and rotary gear means rigidly mounted on the front plate and aligned with the central opening therein, the rotary gear means engaging and intermeshing with the longitudinal gear section of the rear plate when the front plate is mounted on the rotary support means to place the rear plate and the front plate in assembled relation, means for retaining the rear plate and the front plate in assembled relation, the improvement comprising a particular arrangement of the elements recited above, wherein the guide rail is displaced from the rear plate, the reciprocal moving means is displaced from the plate and mounted for reciprocally moving the longitudinal gear section, the reciprocal moving means having opposite ends, with a first end of the reciprocal moving means fixedly secured to the rear plate and an opposite end of the reciprocal moving means fixedly secured to the longitudinal gear section mounted on the guide rail to maximize stability therebetween, the guide rail and the reciprocal moving means are aligned in generally parallel alignment and such parallel alignment is maintained during the reciprocal movement of the longitudinal gear section along the longitudinal axis of the guide rail.

2. An improved load-tilt attachment as claimed in claim 1 wherein the longitudinal gear section comprises a rack mounted on the guide rail for reciprocal movement, said reciprocal moving means for the rack comprises a double acting hydraulic cylinder in parallel alignment with the guide rail and the plate rotary support means comprises a post rigidly mounted in the rear plate for the mounting of a front plate assembly thereon.

3. An improved load-tilt attachment as claimed in claim 1 or 2 wherein the guide rail is rigidly mounted on the rear plate at opposite ends thereof, said rigid mounting means for the guide rail acting as stops for the longitudinal gear section at opposite ends of the guide rail.

4. An improved load-tilt attachment as claimed in claims 1 or 2 wherein the plate rotary support means includes a collar provided between the rear plate and the plate rotary support means to provide a stop adjacent the plate rotary support means whereby the rotary gear means mounted on the front plate engages the collar to provide adequate clearance between the front plate and the rear plate for the attachment assembly mounted therebetween.

5. An improved load-tilt attachment as claimed in claims 1 or 2 wherein protective means mounted on either the front or rear plate overlies the mechanical elements of the load-tilt attachment to protect them from their environment 6. An improved load-tilt attachment as claimed in claim 5 wherein the protective means comprises a generally triangular shaped member rigidly mounted on the rear plate and sized to overlie the mechanical elements of the load-tilt attachment.

7. An improved load-tilt attachment as claimed in claims 1 or 2 wherein the means for retaining the rear plate and the front plate in assembled relation comprises a retainer cap mounted on the rotary support means, and appropriate fastening means securing the cap to the rotary support means to hold the rear plate and the front plate in assembled relation.

8. An improved load-tilt attachment as claimed in claim 7 wherein the cap has a diameter larger than the diameter of the rotary support means thereby to overlay the front plate and retain the front plate in assembled relation with the rotary support means, the rear plate and the associated elements of the load-tilt attachment.

9. An improved load-tilt attachment mountable on the upright of a vehicle, said load-tilt attachment comprising a rear plate, a linear guide rail rigidly secured to the rear plate to receive a longitudinal gear section mounted on the guide rail for reciprocal movement thereon, a double-acting hydraulic cylinder for reciprocally moving the longitudinal gear section along the guide rail, said means displaced from and in parallel alignment with the guide rail, plate rotary support means comprising a post mounted on the rear plate adjacent the guide rail and the rack mounted thereon, a front plate mounted on the post for rotary movement of the front plate with respect to the rear plate, mounting means on the front plate comprising a central opening received on the post of the rear plate and a pinion gear rigidly mounted on the front plate and aligned with the central opening therein, the pinion gear engaging and intermeshing with the longitudinal gear section of the rear plate when the front plate is mounted on the post to place the rear plate and front plate in assembled relation, means for retaining the rear plate and the front plate in assembled relation, the improvement comprising a particular arrangement of the elements recited above, wherein the guide rail is displaced from the rear plate, the hydraulic cylinder is displaced from the rear plate for reciprocally moving the rack mounted on the guide rail, the cylinder, having opposite ends, with a first end of the cylinder fixedly secured to the rear plate and an opposite end of the cylinder fixedly secured to the rack mounted on the guide rail to maximize stability therebetween, the guide rail and the cylinder aligned in generally parallel relation and such parallel relation is maintained during reciprocal movement of the rack along the longitudinal axis of the guide rail.

10. An improved load-tilt arrangement as claimed in claim 9 wherein the guide rail is rigidly mounted on the rear plate at opposite ends thereof, said rigid mounting means for the guide rail acting as stops for the rack at opposite ends of the guide rail.

11. An improved load-tilt attachment as claimed in claim 9 wherein the post means includes a collar provided between the rear plate and the post to provide a stop adjacent the post whereby the pinion gear mounted on the front plate engages the collar to provide adequate clearance between the front plate and the rear plate for the attachment assembly mounted therebetween.

12. An improved load-tilt attachment as claimed in claim 9 wherein protective means mounted on either the front or rear plate overlies the mechanical elements of the load-tilt attachment to protect them from their environment.

13. An improved load-tilt attachment as claimed in claim 12 wherein the protective means comprises a generally triangular shaped member rigidly mounted on the rear plate and sized to overlie the mechanical elements of the load-tilt attachment.

14. An improved load-tilt attachment as claimed in claim 9 wherein the means for retaining the rear plate and the front plate in assembled relation comprises a retainer cap mounted on the post, and appropriate fastening means securing the cap to the post to hold the rear plate and the front plate in assembled relation.

15. An improved load-tilt attachment as claimed in claim 14 wherein the cap has a diameter larger than the diameter of the post thereby to overlay the front plate and retain the front plate in assembled relation with the post, the rear plate and the associated elements of the load-tilt attachment.

16. An improved load-tilt attachment mountable on the upright of a vehicle, said load-tilt attachment comprising a rear plate, a linear guide rail rigidly secured to the rear plate, a longitudinal gear section mounted on the guide rail for reciprocal movement thereon, a double-acting hydraulic cylinder for reciprocally moving the longitudinal gear section along the guide rail, said cylinder displaced from and in parallel alignment with the guide rail, plate rotary support means comprising a post mounted on the rear plate adjacent the guide rail and the rack mounted thereon, a front plate mounted on the post for rotary movement of the front plate with respect to the rear plate, mounting means on the front plate comprising a central opening received on the post of the rear plate and a pinion gear rigidly mounted on the front plate and aligned with the central opening therein, the pinion gear engaging and intermeshing with the longitudinal gear section of the rear plate when the front plate is mounted on the post to place the rear plate and front plate in assembled relation, means for retaining the rear plate and the front plate in assembled relation, the improvement comprising a particular arrangement of the elements recited above, wherein the guide rail is displaced from the rear plate, the guide rail is in generally horizontal alignment, the hydraulic cylinder is displaced from the rear plate and mounted for reciprocally moving the rack on the guide rail, the cylinder having opposite ends, with a first end of the cylinder fixedly secured to the rear plate and an opposite end of the cylinder fixedly secured to the rack mounted on the guide rail to maximize stability therebetween, the guide rail and the cylinder aligned in generally parallel relation and such parallel relation is maintained during reciprocal movement of the rack along the longitudinal axis of the guide rail.

17. An improved load-tilt arrangment as claimed in claim 16 wherein the guide rail is rigidly mounted on the rear plate at opposite ends thereof, said rigid mounting means for the guide rail acting as stops for the rack at opposite ends of the guide rail.

18. An improved load-tilt attachment as claimed in claim 16 wherein the post means includes a collar provided between the rear plate and the post to provide a stop adjacent the post whereby the pinion gear mounted on the front plate engages the collar to provide adequate clearance between the front plate and the rear plate for the attachment assembly mounted therebetween.

19. An improved load-tilt attachment as claimed in claim 16 wherein protective means mounted on either the front or rear plate overlies the mechanical elements of the load-tilt attachment to protect them from their environment.

20. An improved load-tilt attachment as claimed in claim 19 wherein the protective means comprises a generally triangular shaped member rigidly mounted on the rear plate and sized to overlie the mechanical elements of the load-tilt attachment.

21. An improved load-tilt attachment as claimed in claim 16 wherein the means for retaining the rear plate and the front plate in assembled relation comprises a retainer cap mounted on the post, and appropriate fastening means securing the cap to the post to hold the rear plate and the front plate in assembled relation.

22. An improved load-tilt attachment as claimed in claim 21 wherein the cap has a diameter larger than the diameter of the post thereby to overlay the front plate and retain the front plate in assembled relation with the post, the rear plate and the associated elements of the load-tilt attachment.

* * * * *